United States Patent [19]

Snedker

[11] 4,449,637

[45] May 22, 1984

[54] ANTI-TAMPERING DEVICES FOR BOTTLES

[75] Inventor: Robert Snedker, Hemel Hemstead, England

[73] Assignee: Seagram Distillers Limited, Paisley, Scotland

[21] Appl. No.: 425,757

[22] Filed: Sep. 28, 1982

Related U.S. Application Data

[63] Continuation-in-part of Ser. No. 242,352, Mar. 10, 1981, Pat. No. 4,377,242.

[30] Foreign Application Priority Data

Mar. 12, 1980 [GB] United Kingdom ..... 8008356
Jan. 29, 1982 [GB] United Kingdom ..... 8202517

[51] Int. Cl.[3] ..... B65D 49/02
[52] U.S. Cl. ..... 215/21
[58] Field of Search ..... 215/21, 22, 23

[56] References Cited

U.S. PATENT DOCUMENTS 3,073,470 1/1963 Greene ..... 215/22
4,067,472 1/1978 Cruickshank ..... 215/22

*Primary Examiner*—Donald F. Norton
*Attorney, Agent, or Firm*—Kane, Dalsimer, Kane, Sullivan & Kurucz

[57] ABSTRACT

An anti-tampering bottle closure comprising an outer member in the form of a sleeve which is insertable into the neck of a bottle and an inner member in the form of a tubular valve body made of a substantially more rigid material than the sleeve. A ball valve is trapped within the valve body and adapted to allow liquid to be poured from the bottle when it is inverted but prevent liquid from being poured into the bottle when it is upright. The sleeve has a thickened wall portion and the valve body is axially insertable into the sleeve to compress the thickened wall portion against the neck of the bottle so as to resist radially inward deformation of the thickened wall portion of the sleeve and thereby lock the closure in the neck of a bottle. Preferably, the thickened wall portion of the sleeve forms an inwardly convex annular protrusion which is deformed outwardly into locking engagement with the bottle neck when the valve body is inserted into the sleeve.

19 Claims, 5 Drawing Figures

ANTI-TAMPERING DEVICES FOR BOTTLES

CROSS REFERENCE TO RELATED APPLICATIONS

This application is a continuation-in-part of U.S. patent application Ser. No. 242,352, filed Mar. 10, 1981, now U.S. Pat. No. 4,377,242 entitled Anti-Tampering Device for Bottles, the disclosure of which is incorporated herein by reference.

FIELD OF THE INVENTION

This invention relates to anti-tampering closures for bottles and more particularly concerns a closure intended to prevent or impede the addition of adulterating liquid to the contents of a bottle.

BACKGROUND OF THE INVENTION

In order to prevent the contents of a bottle from being adulterated or diluted it is necessary to provide a closure which incorporates a one way valve which will allow the contents to be poured fully from the bottle when it is inverted but will prevent liquid from being poured into the bottle when it is upright. It is also necessary for the valve to be protected so that it cannot be held open when the bottle is upright. It is further necessary for the closure to be locked permanently in the neck of the bottle so that it cannot be removed without breaking the bottle. The closure must also be designed so that it is difficult and preferably impossible to cut the valve portion away thereby opening the bottle while leaving portions of the closure locked in the neck.

Many attempts have been made in the past to design a closure which will meet these requirements but so far as is known prior closures have always been susceptible to some form of damage or interference, or they have been expensive to manufacture or they have been difficult to assemble in the bottle neck.

SUMMARY OF THE INVENTION

It is therefore an object of the present invention to provide an anti-tampering bottle closure which will meet the aforenoted requirements and which, at the same time is inexpensive to manufacture and easy to insert in a bottle neck.

According to one aspect of this invention there is provided an anti-tampering bottle closure comprising an outer member in the form of a sleeve which is insertable into the neck of a bottle, an inner member in the form of a tubular valve body made of a substantially more rigid material than the sleeve and a ball valve trapped within the valve body and adapted to allow liquid to be poured from the bottle when it is inverted but prevent liquid from being poured into the bottle when it is upright, wherein the sleeve has a thickened wall portion and the valve body is axially insertable into the sleeve to compress the thickened wall portion against the neck of a bottle and thereafter resist radially inward deformation of the thickened wall portion of the sleeve to thereby lock the closure in the neck of the bottle.

According to a further aspect of the invention there is provided the combination of a bottle incorporating a closure as defined in the preceding paragraph, wherein the internal surface of the neck of the bottle is formed with an annular groove, the closure is located in the neck with the thickened wall portion of the sleeve substantially filling the annular groove and the valve body is located within the sleeve so as to support the thickened wall portion and lock the closure against withdrawal from the bottle.

BRIEF DESCRIPTION OF THE DRAWINGS

Thus by the present invention, the aforenoted objects, advantages and others will be realized, the description of which should be taken in conjunction with the following drawings wherein.

DETAILED DESCRIPTION OF THE PREFERRED EMBODIMENT

Figure 1:
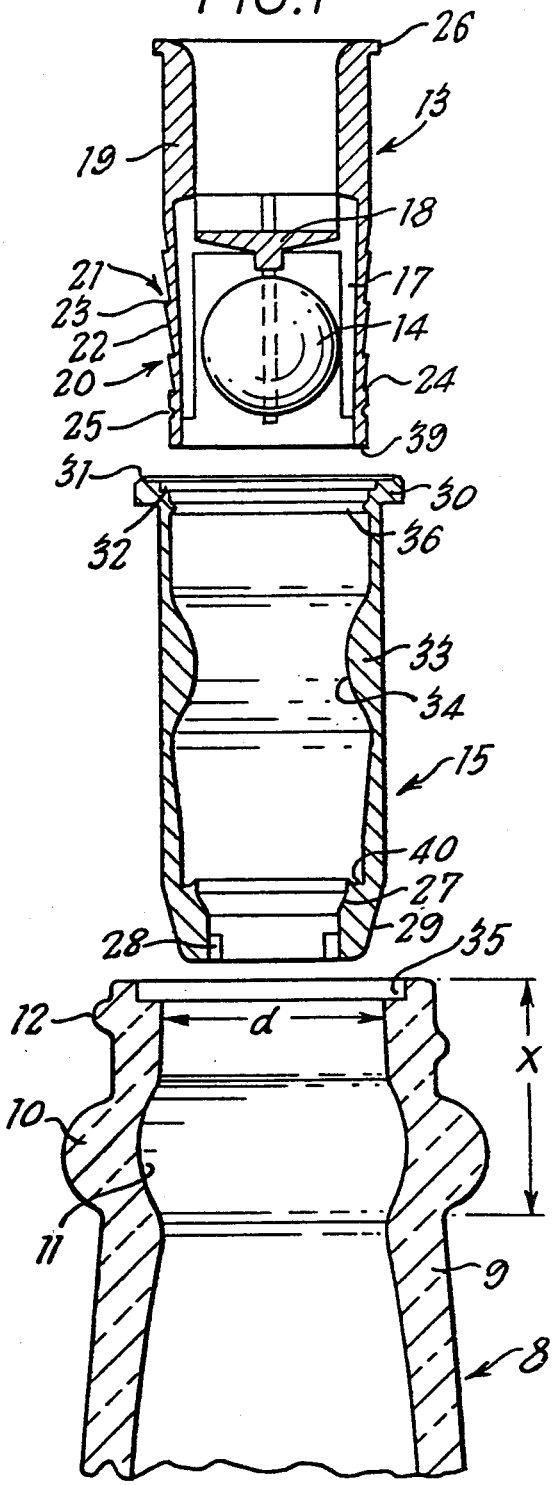
FIG. 1 is an exploded sectional elevation of the components of a closure device according to the invention, and shows also the neck portion of a bottle to receive the closure.

Most bottles are manufactured with an external enlargement on the neck, known as a transfer ring, which is formed during the initial stage of manufacturing the bottle to enable the gob of molten glass from which the bottle is formed to be held securely during its transfer to a hollow mold for blowing into the required form. Subsequently, the transfer ring may serve to enable a closure to be held in place on the neck or to retain a security, or so-called pilfer-proof, band. During cooling of the bottle the provision of the transfer ring results in the formation of a shallow groove on the internal surface of the neck at a location opposite the transfer ring. In the arrangement illustrated in the drawings the groove is used to provide an anchorage for an anti-tampering closure device mounted within the neck of the bottle.

Referring to FIG. 1 of the drawings, a bottle is indicated generally at 8, the bottle 8 having a neck portion 9. The bottle neck 9 has a transfer ring 10 and an internal groove 11. Above the ring a short external screw thread 12 is provided for retaining a cap.

The closure, also shown in FIG. 1, comprises an inner part in the form of a tubular valve body 13, an outer part in the form of a sleeve 15 and a non-return valve comprising a valve ball 14 and a valve seat 27 on the lower end of the sleeve 15.

The valve body is moulded from a tough relatively hard plastic material such as for example polypropylene and has four internal lengthwise-extending ribs 17 which serve to guide the movement of the ball 14, and an integral transversely extending circular baffle 18 which limits upward movement of the ball and protects the ball from interference. The baffle 18 is joined to the radially inner edges of the ribs 17.

Beneath a cylindrical outer surface portion 19 the body is formed with a series of axially spaced annular upwardly pointing teeth or ridges 20, each comprising an upwardly and outwardly inclined annular shoulder 21 and a conically inclined surface 22 adjoining the shoulder 21 at a circumferential edge 23 to produce a barb-like configuration. Beneath the lowermost tooth 20 and near the lower end of the body, is an upwardly-facing abutment shoulder 24 and below this shoulder 24 is an annular groove 25. At the bottom of the body is a downwardly facing shoulder 39. At its upper end, the body has an outwardly projecting flange 26.

The outer sleeve 15 is molded from a tough but relatively deformable resilient plastic material, for example polyethylene, and is formed at its lower end with an internal frustoconical seat 27 for the ball 14. Below the seat, the sleeve 15 has four radially-inwardly projecting ribs 28 which prevent the ball from becoming jammed against the seat and which also prevents the valve from forming a complete seal, for a reason later discussed. Immediately, above the seat 27 is an upwardly facing annular abutment shoulder 40 against which the shoulder 39 of the valve body 14 can abut. The external surface 29 of the sleeve 15 at its lower end is frustoconical.

Above the surface 29, the sleeve 15 is generally cylindrical with a radially-outwardly extending flange 30 at its upper end to seat within an annular rebate 35 formed at the upper end of the bottle neck. The flange has an upstanding ridge 31 and radially inwardly thereof a rebate 32 to accommodate the flange 26 of the tubular valve body. The cylindrical wall of sleeve 15 is not of uniform thickness, but has an annular thickening or protuberance 33 which presents a convexly curved radially inner surface 34. The positioning and shape of the protuberance 33 is such that when the flange 30 is in the rebate 35 of the bottle, insertion of the valve body into the sleeve will cause deformation of the sleeve 15 and a radially outward expansion of the protuberance 33 into the shallow groove 11 in the neck of the bottle.

The axial distance X between the bottle mouth and the inner edge of the groove 11 is customarily less than the internal diameter "d" of the bottle mouth and the protuberance 33 is positioned accordingly, i.e., so that the innermost point of the protuberance is spaced from that part of the sleeve which will lie outermost in the neck, disregarding the flange 30, by a distance less than the outer diameter of the sleeve.

The closure is assembled by placing the ball 14 in the sleeve 15, and then inserting the valve body within the sleeve 15 so that a rib 26 at the upper end of the sleeve engages in the external groove 25 in the lower end portion of the body to secure the two components temporarily together.

Figure 2:
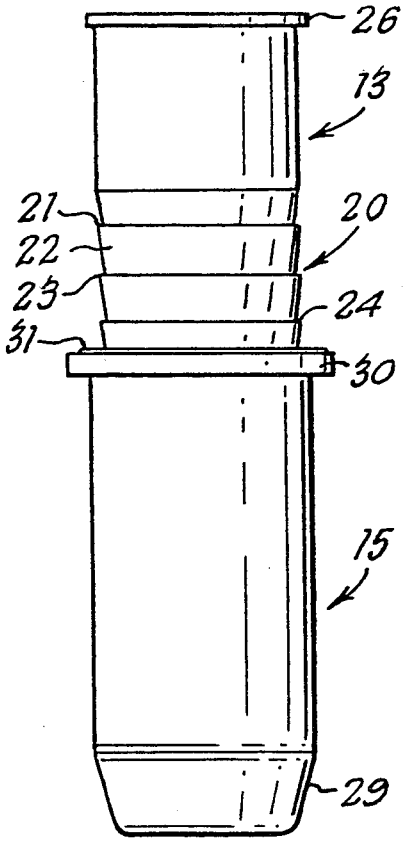
FIG. 2 is an external elevation of the assembled closure prior to securing.
Figure 3:
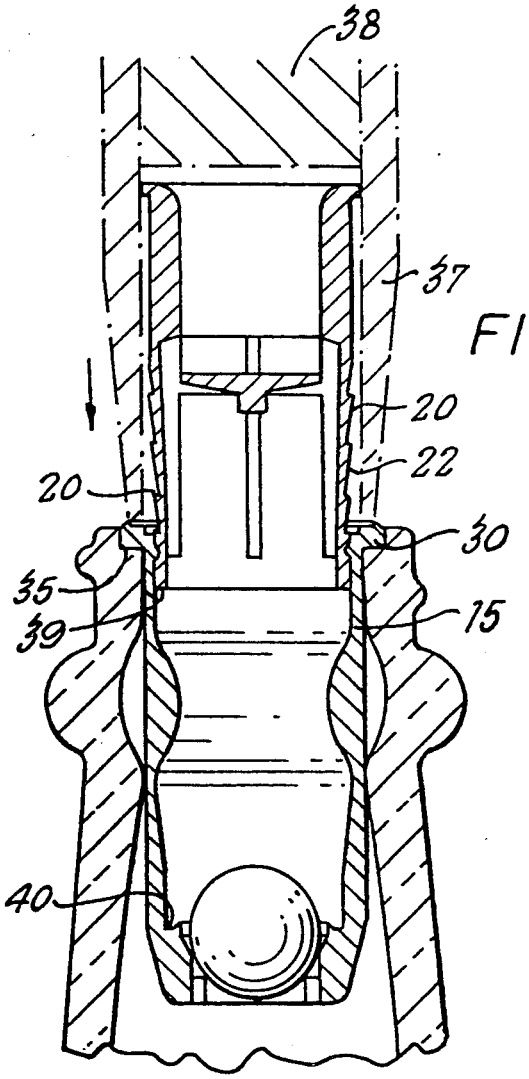
FIG. 3 shows the assembled closure in position in the bottle neck and about to be secured.
Figure 4:
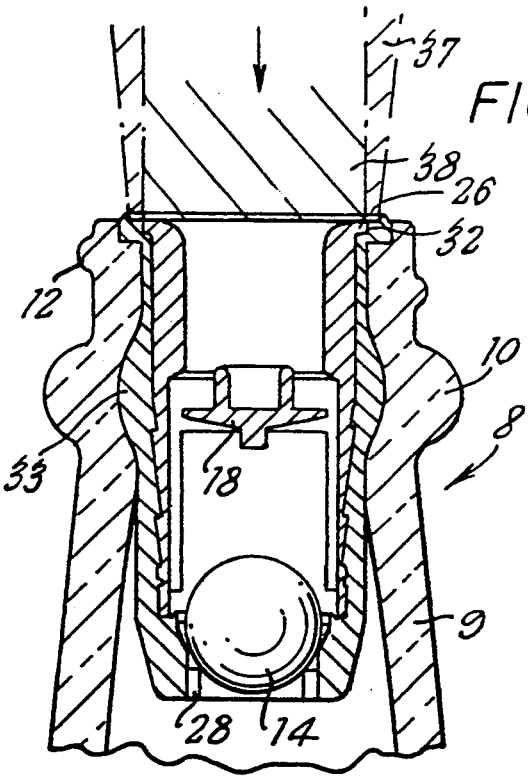
FIG. 4 shows the closure secured in the bottle.

The closure now has an external appearance as shown in FIG. 2, the protuberance of the sleeve remaining in its initial projecting position, and the closure is presented to the bottle in this condition after the bottle has been filled in manufacture. By means of an assembly tool having a collet 37 (see FIG. 3) which engages only the flange 30 of the sleeve 15, the closure is pressed into the bottle until the flange 30 seats in the rebate 35 at the top of the bottle. A plunger 38 within the sleeve 37 of the assembly tool is then employed (see FIG. 4) to press the tubular valve body downwardly until its upper flange 26 seats in the rebate 32 of the flange 30, in which condition the upper faces of the flanges 26 and 30 are substantially flush. During this downward movement of the valve body the groove 25 in the valve body disengages from the rib 36 in the sleeve and the lower edge of the valve body engages the internal convex surface 34 of the protuberance 33 and forces the protuberance outwardly into firm engagement with the internal groove 11 in the bottle neck. In the final part of the movement of the valve body the lower shoulder 39 of the valve body 13 comes into abutment with the shoulder 40 of the sleeve to prevent further movement of the valve body into the sleeve. During the downward movement of the valve body, which is a force-fit into the sleeve, the relatively hard teeth 20 bite into, and produce a resilient deformation of, the inner surface of the relatively soft and deformable sleeve. The shallow angle of outward inclination of surfaces 22 permits the insertion of the valve body into the sleeve. However in the final position of the body, as can be seen in FIG. 4, the teeth prevent or inhibit withdrawal of the valve body from the sleeve by providing a ratchet action in which the upwardly pointing teeth tend to bite further into the sleeve if withdrawal is attempted.

Figure 5:
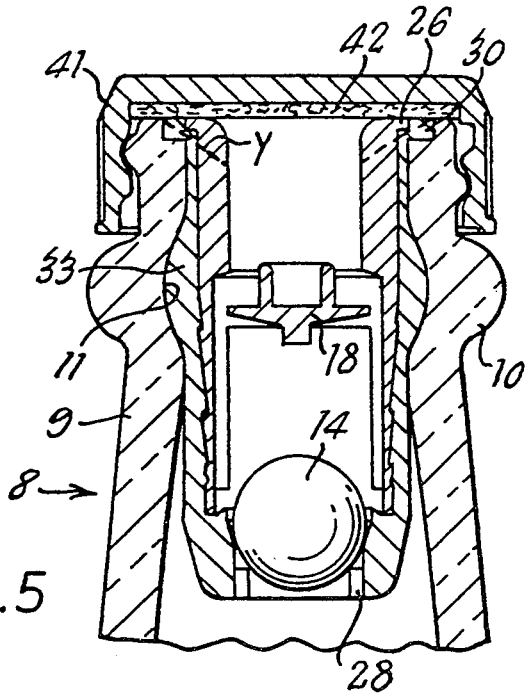
FIG. 5 shows the finished bottle equipped with a screw cap.

Referring now to FIG. 5, a screw-cap 41 with or without a sealing wad 42 is then applied to the bottle so as to form a seal with the ridge 31 on the flange of the sleeve, and seat on the flush upper surfaces of the bottle neck, flange 26 and flange 30.

When the screw-cap 41 is removed, the contents of the bottle can be poured out in the ordinary way, the liquid pushing the ball 14 off its seat and flowing past the ball and the baffle 18 when the bottle is tilted. When the bottle is returned to its vertical position the slight leakage permitted by the presence of the ribs 28 which space the ball slightly from the valve seat 27 enables the residual liquid above the ball to seep slowly back past the ball. However, the valve prevents the addition of adulterating liquid to the remaining contents of the bottle except at a very slow rate and thus substantially hinders and discourages attempts at adulteration.

It will be understood that the ball must have a density in excess of that of the liquid contents of the bottle.

Since the bottle, when fitted with an anti-tampering closure as described above presents a substantially flat annular upper surface, by virtue of rebating of the bottle neck at 35 and of the upper flange 30 of the sleeve 15, metal closures of the roll-on and roll-on pilfer proof types can readily be used in place of the screw cap 41 of FIG. 5.

The described device is of simple construction, since it comprises only three separate parts, namely the tubular valve body, the sleeve, and the valve ball and is readily assembled into a condition in which it is locked in the bottle neck. The configuration of the closure is such that in this locked condition any axial movement of the tubular body and consequently of the whole closure, either inwardly or outwardly of the bottle, is extremely difficult. More particularly, the teeth 20 inhibit withdrawal of the valve body from the sleeve, and an attempt to push the valve body into the bottle, even if a circumferential cut is made in the mouth of the bottle along line Y (see FIG. 5) to shear away and remove the retaining flange 26 of the tubular body, will fail due to the restraining affect provided by the abutment of surface 39 against the abutment shoulder 40.

Thus by the aforenoted invention, its objects and advantages are readily realized and although a preferred embodiment has been disclosed and described in detail herein, its scope should not be limited thereby rather its scope should be determined by that of the appended claims.

What is claimed is:

1. An anti-tampering bottle closure comprising an outer member in the form of a sleeve which is insertable into a neck of a bottle, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve whereupon the insertion of the valve body into the sleeve and neck causes the thickened wall portion to permanently compress against the neck of a bottle and thereafter resist radially inward deformation of the thickened wall portion of the sleeve to thereby lock the closure in the neck of a bottle.

2. An anti-tampering bottle closure, comprising: a closure having an outer member in the form of a sleeve which is insertable into a neck of the bottle wherein said neck includes an internal surface formed with an annular groove, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve whereupon the insertion of the valve body into the sleeve and neck causes the thickened wall portion to compress against the neck and substantially fill the groove in the neck with the valve body positioned in the sleeve so as to support the thickened wall portion and lock the closure against withdrawal from the bottle.

3. An anti-tampering bottle closure in accordance with claim 1 or 2 wherein the sleeve has an internal abutment surface adapted to limit movement of the valve body into the sleeve.

4. An anti-tampering bottle closure comprising an outer member in the form of a sleeve which is insertable into a neck of a bottle, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion which forms an inwardly convex annular protrusion and the valve body being axially insertable into the sleeve whereupon the insertion of the valve body into the sleeve and neck causes the thickened wall portion to deform outwardly to compress against the neck of a bottle and thereafter resist radially inward deformation of the thickened wall portion of the sleeve to thereby lock the closure in the neck of a bottle.

5. An anti-tampering bottle closure in combination with a bottle, comprising: a closure having an outer member in the form of a sleeve which is insertable into a neck of the bottle wherein said neck includes an internal surface formed with an annular groove, an inner member in the form of a tubular valve body made of a substantially more rigid material than that of the sleeve and a ball valve trapped within the valve body and adapted to allow liquid to be poured into the bottle when it is upright, said sleeve having a thickened wall portion which forms an inwardly convex annular protrusion and the valve body being axially insertable into the sleeve whereupon the insertion of the valve body into the sleeve and neck causes the thickened wall portion to deform outwardly to compress against the neck and substantially fill the groove in the neck with the valve body positioned in the sleeve so as to support the thickened wall portion and lock the closure against withdrawal from the bottle.

6. An anti-tampering bottle closure comprising an outer member in the form of a sleeve which is insertable into a neck of a bottle, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said valve body including a plurality of projections adapted to bite into the sleeve in the region of the thickened wall portion to resist withdrawal of the valve body from the sleeve and whereupon the insertion of the valve body into the sleeve and neck causes the thickened wall portion to compress against the neck of a bottle and thereafter resist radially inward deformation of the thickened wall portion of the sleeve to thereby lock the closure in the neck of a bottle.

7. An anti-tampering bottle closure in combination with a bottle, comprising: a closure having an outer member in the form of a sleeve which is insertable into a neck of the bottle wherein said neck includes an internal surface formed with an annular groove, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said valve body including a plurality of projections adapted to bite into the sleeve in the region of the thickened wall portion to resist withdrawal of the valve body from the sleeve and whereupon the insertion of the valve body into the sleeve and neck causes the thickened wall portion to compress against the neck and substantially fill the groove in the neck with the valve body positioned in the sleeve so as to support the thickened wall portion and lock the closure against withdrawal from the bottle.

8. An anti-tampering bottle closure in accordance with claim 6 or 7 wherein the projections are in the form of a plurality of annular teeth.

9. An anti-tampering bottle closure in combination with a bottle, comprising: a closure having an outer member in the form of a sleeve which is insertable into a neck of the bottle wherein said neck includes an internal surface formed with an annular groove, an inner member in the form of a tubular valve body made of a substantially rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said sleeve has an internal abutment surface adapted to limit movement of the valve body into the sleeve and said valve body has an external flange at one end which is adapted to seat in a rebate formed in the sleeve when the valve body is inserted fully into the sleeve and whereupon the insertion of the valve body into the sleeve and neck causes the thickened wall portion to compress against the neck of a bottle and thereafter resist radially inward deformation of the thickened wall portion of the sleeve to thereby lock the closure in the neck of a bottle.

10. An anti-tampering bottle closure comprising an outer member in the form of a sleeve which is insertable into a neck of a bottle, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said sleeve has an internal abutment surface adapted to limit movement of the valve body into the sleeve and said valve body has an external flange at one end which is adapted to seat in a rebate formed in the sleeve when the valve body is inserted fully into the sleeve, whereupon the insertion of the valve body into the sleeve and neck causes the thickened wall portion to compress against the neck of a bottle and thereafter resist radially inward deformation of the thickened wall portion of the sleeve to thereby lock the closure in the neck of a bottle.

11. An anti-tampering bottle closure in accordance with claim 9 or 10 wherein the sleeve is formed with an external flange at one end which is adapted to seat in a rebate in the bottle neck when the sleeve is inserted into a bottle.

12. An anti-tampering bottle closure comprising an outer member in the form of a sleeve which is insertable into a neck of a bottle, an inner member in the form of a tubular valve body made of a substantially more rigid material than that of the sleeve and a ball valve trapped within the valve body and movable between a baffle which is integral with the valve body and a valve seat formed on the sleeve and adapted to allow liquid to be poured from the bottle when it is inverted but prevent liquid from being poured into the bottle when it is upright, said sleeve having a thickened wall portion and the valve body being axially insertable into the sleeve whereupon the insertion of the valve body into the sleeve and neck causes the thickened wall portion to compress against the neck of a bottle and thereafter resist radially inward deformation of the thickened wall portion of the sleeve to thereby lock the closure in the neck of a bottle.

13. An anti-tampering bottle closure in combination with a bottle, comprising: a closure having an outer member in the form of a sleeve which is insertable into a neck of the bottle wherein said neck includes an internal surface formed with an annular groove, an inner member in the form of a tubular valve body made of a substantially more rigid material than that of the sleeve and a ball valve trapped within the valve body and movable between a baffle which is integral with the valve body and a valve seat formed on the sleeve and adapted to allow liquid to be poured from the bottle into the bottle when it is upright, said sleeve having a thickened wall portion and the valve body being axially insertable into the sleeve whereupon the insertion of the valve body into the sleeve and neck causes the thickened wall portion to compress against the neck and substantially fill the groove in the neck with the valve body positioned in the sleeve so as to support the thickened wall portion and lock the closure against withdrawal from the bottle.

14. An anti-tampering bottle closure in accordance with claim 12 or 13 wherein the valve body has axially extending ribs which are adapted to guide movement of the ball valve within the valve body.

15. An anti-tampering bottle closure in accordance with claim 12 or 13 wherein the baffle in the valve body is so positioned within the valve body that it is located generally adjacent the thickened portion of the sleeve when the valve body is fully inserted within the sleeve.

16. An anti-tampering bottle closure comprising an outer member in the form of a sleeve which is insertable into a neck of a bottle, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said sleeve and the valve body being provided with an interlocking rib and groove arrangement enabling the valve body to be displaceably attached to the sleeve prior to slidable insertion thereof whereupon the insertion of the valve body into the sleeve and neck causes the thickened wall portion to compress against the neck of a bottle and thereafter resist radially inward deformation of the thickened wall portion of the sleeve to thereby lock the closure in the neck of a bottle.

17. An anti-tampering bottle closure in combination with a bottle, comprising: a closure having a outer member in the form of a sleeve which is insertable into a neck of the bottle wherein said neck includes an internal surface formed with an annular groove, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said sleeve and the valve body being provided with an interlocking rib and groove arrangement enabling the valve body to be displaceably attached to the sleeve prior to slidable insertion thereof whereupon the insertion of the valve body into the sleeve and neck causes the thickened wall portion to compress against the neck and substantially fill the groove in the neck with the valve body positioned in the sleeve so as to support the thickened wall portion and lock the closure against withdrawal from the bottle.

18. An anti-tampering bottle closure comprising an outer member in the form of a sleeve which is insertable into a neck of a bottle, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said thickened wall portion of the sleeve being spaced from an end of the sleeve adapted to receive the valve body by a distance less than the sleeve's external diameter whereupon the insertion of the valve body into the sleeve and neck causes the thickened wall portion to compress against the neck of a bottle and thereafter resist radially inward deformation of the thickened wall portion of the sleeve to thereby lock the closure in the neck of a bottle.

19. An anti-tampering bottle closure in combination with a bottle, comprising: a closure having an outer member in the form of a sleeve which is insertable into a neck of the bottle wherein said neck includes an internal surface formed with an annular groove, an inner member in the form of a tubular valve body made of a substantially more rigid material than that of the sleeve and a ball valve trapped within the valve body and adapted to allow liquid to be poured from the bottle when it is inverted but prevent liquid from being poured into the bottle when it is upright, said sleeve having a thickened wall portion and the valve body being axially insertable into the sleeve, said thickened wall portion of the sleeve being spaced from an end of the sleeve adapted to receive the valve body by a distance less than the sleeve's external diameter whereupon the insertion of the valve body into the sleeve and neck causes the thickened wall portion to compress against the neck and substantially fill the groove in the neck with the valve body positioned in the sleeve so as to support the thickened wall portion and lock the closure against withdrawal from the bottle.

* * * * *